US005615429A

United States Patent [19]

Williams

[11] Patent Number: 5,615,429

[45] Date of Patent: Apr. 1, 1997

[54] BED ELEVATING BLOCKS

[76] Inventor: Susan R. Williams, 28649 S. Western Ave. Suite 6757, Rancho Palos Verdes, Calif. 90734

[21] Appl. No.: 386,438

[22] Filed: Feb. 10, 1995

Related U.S. Application Data

[63] Continuation-in-part of Ser. No. 287,629, Aug. 8, 1994, abandoned.

[51] Int. Cl.[6] ..... A47C 21/00

[52] U.S. Cl. ..... 5/509.1

[58] Field of Search ..... 5/509.1

[56] References Cited

U.S. PATENT DOCUMENTS

| | | | |
|---|---|---|---|
| 2,893,164 | 7/1959 | Martin | 5/509.1 |
| 2,933,850 | 4/1960 | Martin | 5/509.1 |
| 4,312,088 | 1/1982 | Webb | 5/509.1 |
| 5,224,227 | 7/1993 | McGinley | 5/509.1 |
| 5,345,631 | 9/1994 | Saperstein et al. | 5/509.1 |

*Primary Examiner*—Michael J. Milano

[57] ABSTRACT

A device for supporting the legs of a bed for the purpose of adjustably raising one end of the bed. The device is designed for ease and safety in stacking by use of a nesting feature in which the walls of a raised boss are nested completely around a socket formed between two concentric circles defined by the inside and outside walls of the adjacent raised bosses.

4 Claims, 2 Drawing Sheets

BED ELEVATING BLOCKS

BACKGROUND AND SUMMARY OF THE INVENTION

This application is a continuation in part of a previous application by the same inventor filed Aug. 8, 1994, Ser. No. 08/287,629, which is abandoned. In that application, a type of elevation block was proposed in which a simple boss on the top of one block fitted into a socket in the base of an adjacent block.

The function of the blocks was to build a raised pillar on which a bed leg might be supported to tilt a bed—particularly a bed for a baby or small child—to provide for easier breathing for the occupant of the bed. That embodiment of the invention will still work to accomplish the desired result.

However, the device can be radically improved by the second embodiment described in this continuation application. The improvement consists in providing a more secure nesting arrangement. This is accomplished by use of a form of boss in which the walls of the boss nest together in addition to having a single insert and single socket.

A more complete understanding of the invention will be apparent from a study of the drawings and the following description of the invention.

DESCRIPTION

Figure 1:
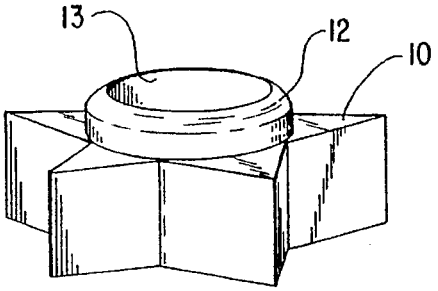
FIG. 1 is a perspective view of a block of the present invention.
Figure 2:
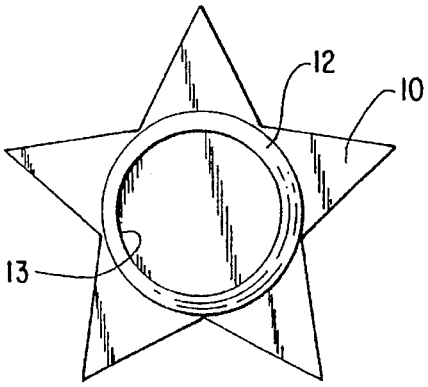
FIG. 2 is a top plan view of the block of FIG. 1.
Figure 3:
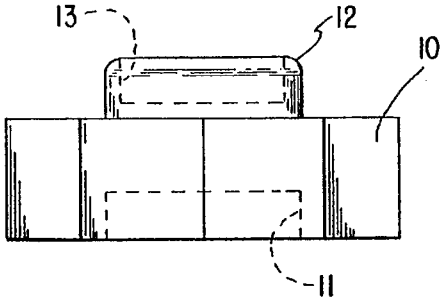
FIG. 3 is a side elevational view of that block.
Figure 4:
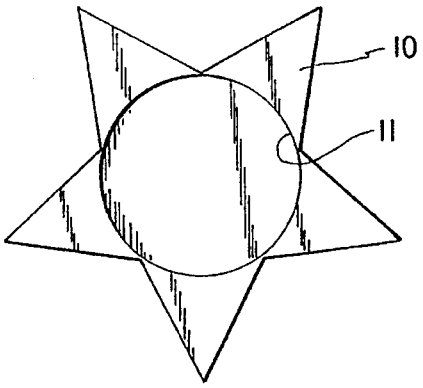
FIG. 4 is a bottom plan view of the block.

Briefly this invention comprises a block or series of identical blocks adapted to be readily stacked and to receive the leg of a bed so as to support that leg in a raised position thereby raising the end of the bed.

More specifically and referring to the drawings, a first embodiment of this invention comprises a block or series of blocks composed of a base 10. Although the base is illustrated as star-shaped, it will be apparent that simpler shapes such as round, oval or square can be used or that more complicated forms such as animal figures or the like might be used for blocks usable with infant beds.

Each block is formed with a socket or hollow 11 in one side of the base. A boss 12 is formed on the top of the block. This boss is of a size and shape to match the socket 11 in a next adjacent block so that any stacking will be relatively stable because of the matching of the boss 12 in the socket 11. Each block has a top and bottom defined by a plane surface so that the bottom will be flat on a floor and the top will matched the bottom of the next upper block.

A dimple 13 is formed in each boss 12. This dimple is designed to receive a bed leg or caster so that the leg would be held to its proper position relative to the top block in a stack.

It will be apparent that when a need arises to raise the end of a bed—usually the head end—that one block under each leg at the end would accomplish the purpose except that in some instances, a higher rise might be desired. In those cases, it is a simple matter, with the block of this invention, simply to stack the blocks by placing the socket 11 of each block, except the bottom one, onto the boss 12 of the next lower block until the desired height is attained.

Figure 5:
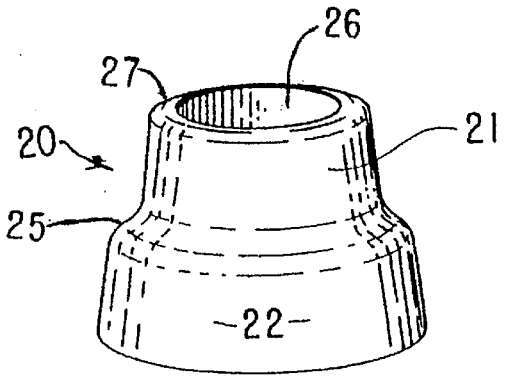
FIG. 5 is a perspective view of a pair of blocks of an alternative embodiment of my invention.
Figure 6:
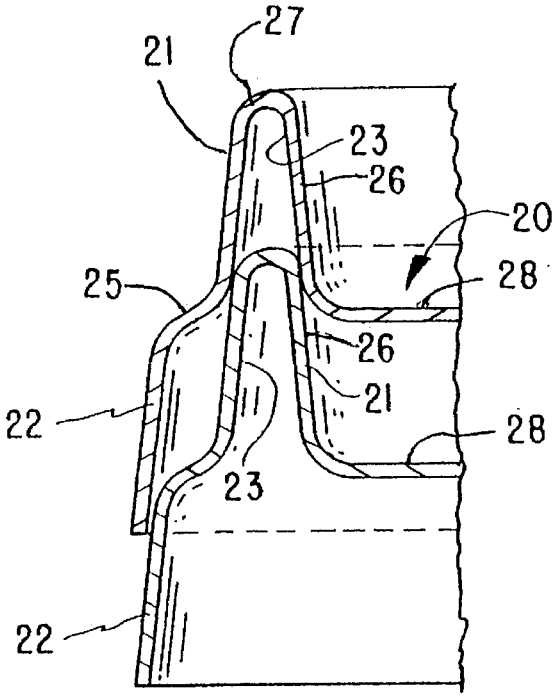
FIG. 6 is a partial radial sectional view of the parts shown in FIG. 5.

A much improved and more safe embodiment, and therefore, a preferred embodiment, is shown in FIGS. 5 and 6. Here the blocks are formed from plastic sheets pressed or molded to the shape shown in those figures.

Each block 20 is formed with a base consisting of a frustro-conical skirt member having a skirt wall 22 having a relatively large diameter (of the order of six inches) at the largest part of the base. The boss is also formed by frustro-conical boss walls 21 joined to the skirt 22 by an annular top wall of similar thickness and material which form a shoulder 25.

The upper dimple is made by molded dimple walls 26 sloping slightly in the opposite direction from the boss walls 21. This shape forms a ring-shaped slot 23 between the boss walls 21 and dimple walls 26, thus resulting in a nesting slot substantially coexistent with the circular slot 23.

The boss walls 21 and dimple walls 26 are, in actuality, formed as a unitary piece, being joined at the upper edges by a U-shaped top wall 27. The bottom floor 28 of the dimple is also formed of the same material and simply provides a floor to support the bed leg.

It will be apparent that in the latter described embodiment, much greater and tighter fitting surfaces for matching are provided. This results in less chance for one block to shift relative to the other and therefore is a safer construction of the support pillar.

I claim as my invention:

1. A support for a bed leg comprising a plurality of stacked members formed of molded walls, said walls including a bass at the top of said member, said top being formed with a dimple having an annular dimple wall and a top wall joining said dimple walls, said top wall forming the bottom of a said dimple on which said bed leg may stand, said molded walls also including a boss wall extending adjacent to said dimple wall but spaced therefrom and extending downward beyond said top wall, said dimple wall and said boss wall forming an annular slot between said boss wall and said dimple wall whereby the corresponding walls of the next adjacent support are nested within said annular slot.

2. The support of claim 1 in which said boss wall and said dimple wall are substantially concentric but in slightly angular elemental relationship whereby said annular slot is tapered to provide snug nesting between adjacent members.

3. The support of claim 1 in which said boss wall extends downward to form an annular shoulder, a skirt wall extending downward from said shoulder.

4. The support of claim 1 in which said skirt is substantially circular having a diameter of not less than six inches.

* * * * *